United States Patent [19]

Geisinger

[11] Patent Number: 4,872,490

[45] Date of Patent: Oct. 10, 1989

[54] GAS EVACUATION APPARATUS FOR UNDERGROUND LIQUID STORAGE TANKS AND METHOD

[75] Inventor: Penrod C. Geisinger, Dewey, Ariz.

[73] Assignee: Vaporless Manufacturing, Inc., Prescott Valley, Ariz.

[21] Appl. No.: 207,395

[22] Filed: Jun. 16, 1988

[51] Int. Cl.[4] ..... B65B 31/04

[52] U.S. Cl. ..... 141/7; 141/59; 141/65; 73/49.2

[58] Field of Search ..... 141/1.5, 7, 59, 51, 141/65, 93, 288, 290, 44, 45; 73/49.2 T

[56] References Cited

U.S. PATENT DOCUMENTS

| | | | |
|---|---|---|---|
| 643,605 | 2/1900 | Pendergraft | 141/59 |
| 2,581,914 | 1/1952 | Darrow | 141/288 |
| 2,598,441 | 5/1952 | Risser | 141/45 |
| 3,016,928 | 1/1962 | Brandt | 141/59 |
| 4,505,308 | 3/1985 | Walker et al. | 141/59 |
| 4,566,504 | 1/1986 | Furrow et al. | 141/59 |

OTHER PUBLICATIONS

Tank System Tightness Tester, Service Tool Division Pamphlet 3/23/70.

*Primary Examiner*—Henry J. Recla
*Attorney, Agent, or Firm*—Cahill, Sutton & Thomas

[57] ABSTRACT

A wand having a length of flexible hose extending therefrom is inserted within an underground fluid filled storage tank. Through actuation of a propulsion system, the wand is directed to a suspected vapor pocket within the tank and temporarily retained in place by floatation. An evacuating pump draws in the vapor through inlets at the extremity of the wand and through the trailing hose to reduce or eliminate the vapor pocket within the tank. Upon elimination of the vapor pocket to a practical extent, the hose and attached wand are withdrawn from the tank.

27 Claims, 2 Drawing Sheets

GAS EVACUATION APPARATUS FOR UNDERGROUND LIQUID STORAGE TANKS AND METHOD

RELATED DISCLOSURE

A description of the present invention was filed in the United States Patent Office under the Document Disclosure Program on Dec. 24, 1986 and assigned Document Disclosure No. 161,160.

BACKGROUND OF THE INVENTION

Field of the Invention

The present invention relates to vapor evacuation systems and, more particularly, to apparatus for evacuating vapor from a fluid filled underground storage tank.

Description of the Prior Art

Underground storage tanks for liquids generally provide safe storage for a period of years. However, due to corrosion, movement of the earth, seismic waves and other disturbances, leaks may develop. Should the leaking fluid have harmful characteristics, a safety hazard may be posed or the soil may be poisoned. Additionally, an economic loss would result. Testing storage tanks for leakage has been practiced for many years and numerous test procedures and devices therefor have been developed. A federal publication entitiled, "Underground Tank Leak Detection Methods: State-of-the-Art Review", published by the Hazardous Waste Engineering Research Laboratory in Cincinnati, Ohio (EPA/600/2-86/001, Jan. 1986) provides a detailed report on the state-of-the-art of leak detection.

Before leak detection can be successfully concluded under most procedures, any gas or vapor pockets within the storage tank should be eliminated. Basically, three types of vapor pockets are possible: one that forms in the high end of a tank when the tank is not perfectly level; one that is trapped at the top of the manway; and, one that is trapped at the top of a drop line. If the vapor pockets are not eliminated for all practical purposes, a change in temperature or pressure of the fluid will cause a change in volume of the vapor pocket with a resulting false reading during leak testing.

SUMMARY OF THE INVENTION

A wand, having a selectively actuatable hydraulic propulsion system, trails a length of flexible hose connected to a vacuum pump via a water/gas separator. The wand includes a selectively inflatable floatation device with conduit therefor being associated with the hose. The hose is also connectable to a source of fluid under pressure to deliver a charge to a jet associated with the wand to effect a propelling force to the wand. Deflectors or stabilizing devices may be used in conjunction with the wand and/or hose to increase the control over the path traversed by the wand and trailing hose.

In operation, the wand and a length of trailing hose is dropped into the fluid within the storage tank having a suspected vapor pocket. Upon energization of the wand propulsion system, the wand will be urged to propel itself in the direction it was aimed. The inflatable floatation device associated with the wand is inflated to buoyantly raise the wand to the vapor pocket. The wand includes an inlet connected via the trailing hose to the source of vacuum for removing the vapor in the vapor pocket and essentially eliminate the vapor pocket. Upon elimination of the vapor pocket, the floatation device is deflated to permit withdrawal of the trailing hose and wand.

With knowledge of the configuration of the tank, control over the length of hose inserted within the tank and selective inflation of the floatation device and with a modicum of skill, the wand can be positioned in proximity to any one of the three types of vapor pockets that might exist.

It is, therefore, a primary object of the present invention to provide apparatus for evacuating vapor pockets in liquid filled tanks.

Another object of the present invention is to provide apparatus for positioning a wand for extracting vapor at a predetermined location within a liquid storage tank.

Still another object of the present invention is to provide apparatus for withdrawing vapor from a vapor pocket located anywhere within a liquid filled storage tank.

Yet another object of the present invention is to provide a propulsion and floatation system for positioning a wand to extract vapor from within a liquid filled tank.

A further object of the present invention is to provide a method for evacuating vapor pockets within a fluid filled storage tank.

A yet further object of the present invention is to provide a method for positioning at a vapor pocket within a liquid filled tank a wand for extracting the vapor from the pocket.

A yet further object of the present invention is to provide a method for inexpensively and rapidly eliminating vapor pockets within an underground storage tank.

These and other objects of the present invention will become apparent to those skilled in the art as the description area proceeds.

The present invention may be described with greater specificity and clarity with reference to the following drawings in which.

DESCRIPTION OF THE PREFERRED EMBODIMENT

Figure 1:
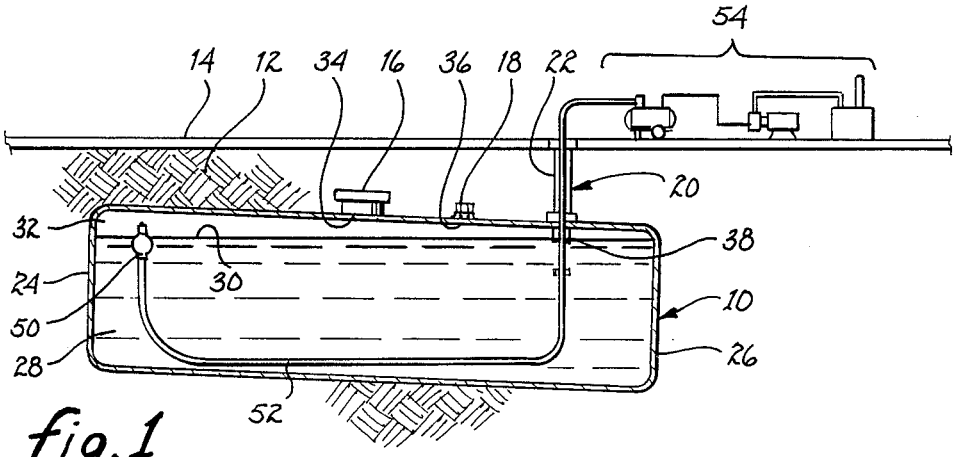
FIG. 1 illustrates a partial cross-sectional view of an underground liquid storage tank and apparatus for evacuating a vapor pocket.

Referring to FIG. 1, there is shown a representative underground storage tank 10 enveloped within soil 12 beneath ground surface 14. Typically, the tank includes a manway 16, a threaded aperture having a plug 18 and a drop line 20. The drop line includes a pipe 22 extending to or above ground surface 14.

Almost never is a storage tank perfectly level at the time of installation or subsequent to installation. At the time of installation, the tank will shift to some extent due to settling of the supporting ground or the settling of any tank supporting elements anchored in the ground. After fill of the tank, the additional weight will cause some settling. Further, after a period of time, natural movement of the earth, changes in apparent weight due to more or less moisture in the ground and other causes will promote some reorientation of the tank. As a result of the non-level orientation of tank 10, one end or the other will be higher. Tank 10 shown in FIG. 1 has end 24 at a higher elevation than end 26, which is illustrated in an exaggerated manner. Fluid 28 within tank 10 will seek its own level 30. Proximate end 24, there will be created a vapor pocket 32. The size of this vapor pocket is a function of the amount of fluid in the tank relative to the capacity of the tank and the depth or height of the vapor pocket is a function of the configuration of the tank. Most underground storage tanks include a manway 16 which may give rise to a vapor pocket 34 associated therewith. Plug 18, depending upon its configuration and its supporting structure of tank 10, may give rise to a further vapor pocket 36. Drop line 20 may also give rise to a vapor pocket 38 extending about that portion of the drop line disposed within tank 10.

Depending upon the nature of fluid 28, leakage from tank 10 may be hazardous from a safety standpoint in the event the fluid is flammable or the fluid may contaminate the adjacent ground and any nearby groundwater. To determine whether tank 10 is leaking fluid 28, any one of numerous leak tests procedures may be conducted using specialized equipment for this purpose. For most such leakage tests, the presence of a vapor pocket of a gallon or two in size may skew the test results or provide erroneous data. It is, therefore, mandatory that any vapor pockets within 10 be eliminated or reduced to an inconsequential size in order to determine accurately whether fluid 28 may be leaking from the tank.

Still referring to FIG. 1, there is shown, in simplified form, apparatus for evacuating vapor pockets from tank 10. The apparatus includes a wand 50 disposed at the end of a flexible hose 52, which wand and hose are introduced into tank 10 through pipe 22 of drop line 20. Associated apparatus 54 includes a source of pressure for ejecting a fluid from wand 50 for the purpose of providing a propulsive force to propel the wand to the location of a suspected vapor pocket. A source of inert gas under pressure is provided to inflate a part of wand 50 to cause to the wand to float at the surface of the suspected vapor pocket. Finally, evacuating means are included to evacuate the vapor within a vapor pocket through wand 50 and hose 52 to a liquid/gas separator tank. With such associated apparatus, wand 50 can be accurately positioned at the location of any suspected vapor pockets and withdraw any vapor that may be present. Necessarily, means are also provided for replenishing fluid 28 commensurate with the depletion of the vapor pockets to prevent introduction of air into the tank.

Figure 3:
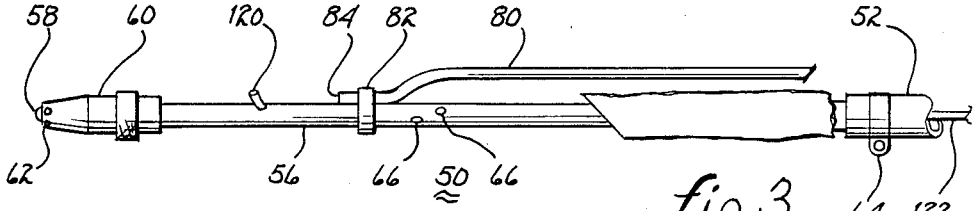
FIG. 3 is a partial view illustrating certain features of the wand.
Figure 2:
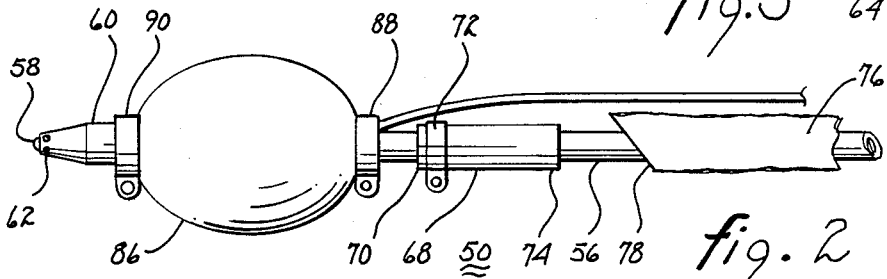
FIG. 2 is a partial detailed view of a wand positioned at the extremity of a trailing hose.

Referring jointly to FIGS. 2 and 3, wand 50 will be described in further detail. The wand includes a tube 56 terminated at one end by a roller ball 58 captured within head 60. The head includes a plurality of inlets 62 disposed in proximity to the roller ball. The other end of tube 56 is secured to hose 52 by means of a clamp 64, or the like. To provide a source of propulsion for wand 50, tube 56 includes one or more apertures 66 disposed in proximity to one another and offset sufficiently to prevent weakening of the tube. A sleeve 68 encircles tube 56 about apertures 66. End 70 of sleeve 68 is secured to the tube by clamp 72, or the like, at a location displaced from apertures 66. End 74 of sleeve 68 is generally concentrically with and radially displaced from tube 56. Deflector 76 is secured to tube 56 to locate angled deflecting surface 78 displaced from and in facing relationship with end 74 of sleeve 68. In one embodiment, the deflector may be a sleeve fitted upon tube 56 and having one end angled to define deflecting surface 78.

A line 80 is secured to a ring 82 or annular expansion formed as part of or attached to tube 56. The line is open at its terminal end 84. An inflatable balloon or bulb 86, having opposed annular ends, penetrably receives tubing 56. The bulb is secured to ring 82 by a clamp 88 and to head 60 by a clamp 90. It is, therefore, apparent that end 84 of line 80 is disposed within bulb 86.

Figure 4:
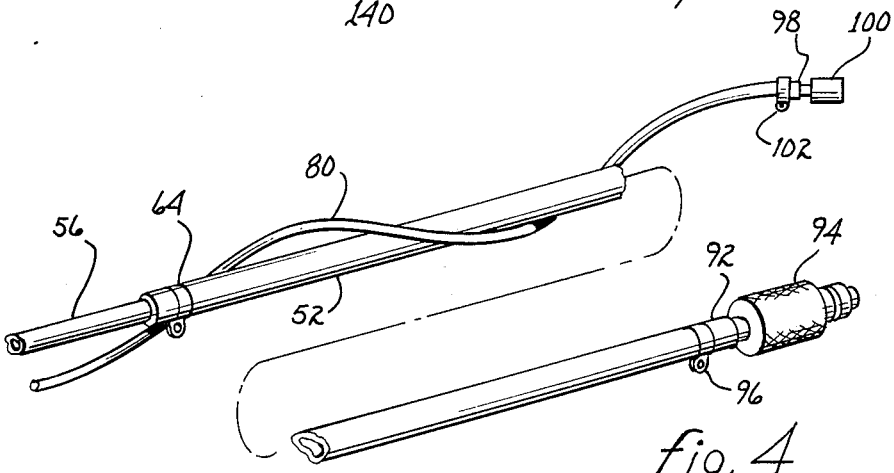
FIG. 4 is a partial view illustrating certain features of the trailing hose.

Referring to FIG. 4, there is shown tube 56 connected to hose 52 by clamp 64. Line 80 may be secured to or wrapped about hose 52 to maintain the hose and the line together. End 92 of hose 52 may be secured to a quick disconnect fitting 94, or the like by means of a clamp 96. Similarly, end 98 of line 80 may be secured to a quick disconnect fitting 100, or the like, by a clamp 102.

Figure 6:
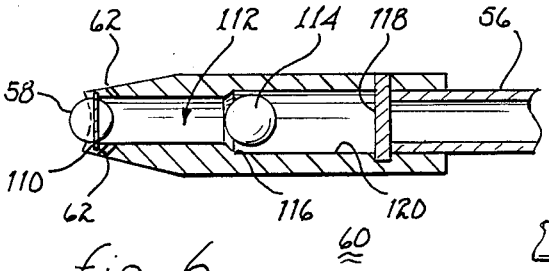
FIG. 6 is a partial cross-sectional view of the wand and illustrating the inlet for evacuating vapor from a vapor pocket.

Head 60 will be described with reference to FIG. 6. The head includes roller 58 captured by and retained with the head by a cage 110. Inlets 62 are in fluid communication with a passageway 112 extending through the head. Passageway 112 may include means for securing the head to tube 56, in a manner well known. A one-way valve is developed within passageway 112. This valve includes a ball 114 captured between seat 116 and stop device 118. The diameter of ball 114 is less than the diameter of expanded portion 120 of passageway 112 to permit fluid flow through portion 120 around the ball. Seat 116, on receiving ball 114, will prevent fluid flow from right to left (as illustrated) through passageway 112. However, the force of flow urged from left to right (as illustrated) will remove ball 114 from seat 116 and flow of fluid can be maintained. The purpose of stop 118 is that of restricting the extent of travel of ball 114 within passageway 112 and the stop should be configured to minimize restriction to fluid flow therepast.

Figure 5:
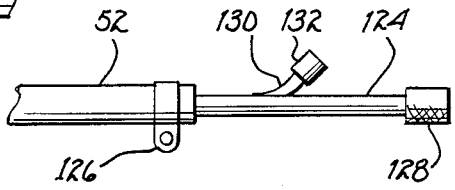
FIG. 5 is a partial view illustrating a variant end of the trailing hose.

Referring jointly to FIGS. 3 and 5, there will be described an alternative embodiment for inflating bulb 86. Obviously, the possibility of entanglement within tank 10 due to a hose 52 and an associated line 80 is greater than if only hose 52 were used. To achieve this goal, line 80 may be disposed within hose 52 with appropriate dimensioning of both the line and the hose. In this embodiment, a hollow stud 120 extends from tube 56 at a location interior of bulb 86 when the latter is mounted upon the tube. The hollow stud is connected to a pipe mounted internally of tube 56. This pipe interconnects with tubing 122 disposed within hose 52. At the other end of hose 52, a length of pipe 124 is in fluid communication with hose 52 and secured thereto by a clamp 126, or the like. The other end of pipe 124 includes a quick disconnect fitting 128, or the like. A branch 130 extends from pipe 124 and may include a quick disconnect fitting 132 or the like. Branch 130 is connected to and in fluid communication with tubing 122. Accordingly, flow through tubing 122 is independent of and segregated from any flow through hose 52.

Thus, by having a single line disposed within tank 10, the probability of entanglement is reduced substantially over that of using a hose and a separate line associated therewith.

Figure 7:
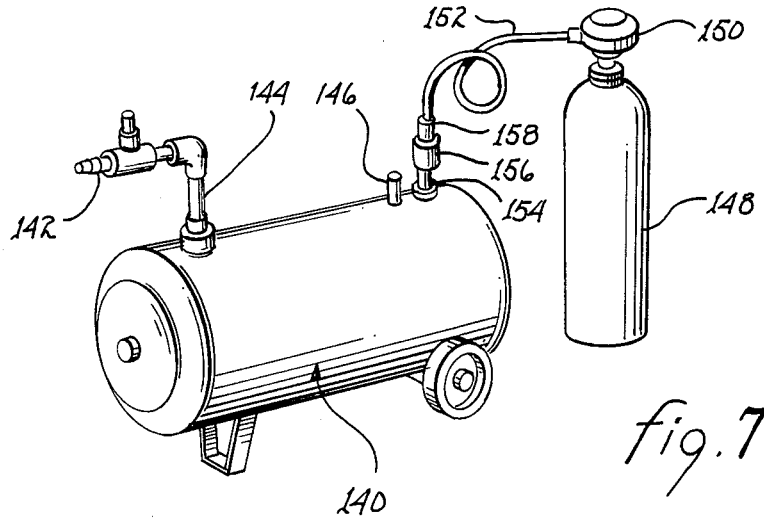
FIG. 7 illustrates apparatus for regulating inflation of the wand.

Referring to FIG. 7, apparatus for manipulating wand 50 within tank 10 to a vapor pocket will be described. A pressure tank 140 includes a quick disconnect fitting 142 for engagement with quick disconnect fitting 94 of hose 52 (or quick disconnect fitting 128 of pipe 124). Quick disconnect fitting 142 is in fluid communication with a hollow stanchion 144 extending essentially to the bottom of pressure tank 140. A further quick disconnect fitting 146, or the like, is located at the top of pressure tank 140 for interconnection with quick disconnect fitting 100 of line 80 (or quick disconnect fitting 132 of branch 130). A pressure vessel 148, including a regulator 150, is connected via high pressure line 152 to fitting 154. The interconnection between the high pressure line and 154 may be by means of quick disconnect fittings 156, 158.

Figure 8:
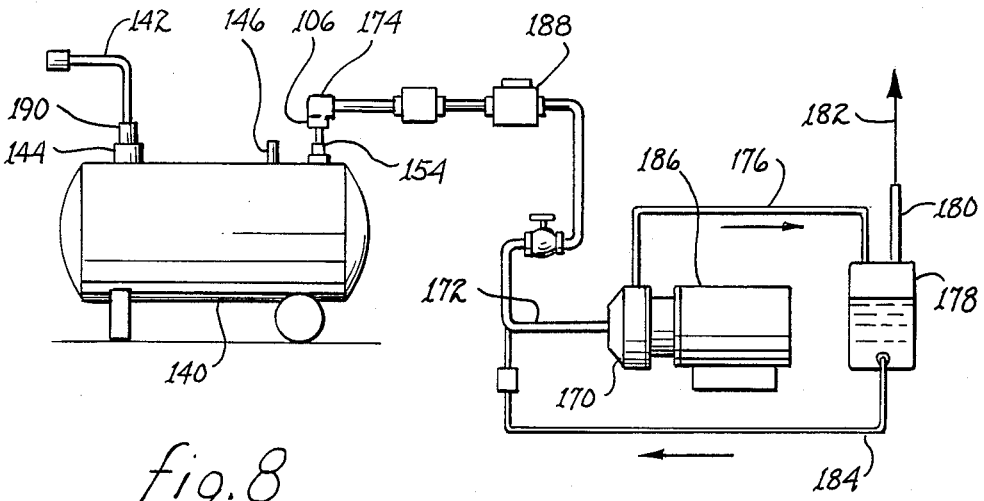
FIG. 8 illustrates apparatus for propelling the wand and drawing vapor through the wand and trailing hose.

Referring to FIG. 8, there is shown apparatus for evacuating the vapor within any vapor pockets in tank 10. An explosion-proof pump 170 includes an intake line 172 connected to fitting 154 through quick disconnect fitting 156 and quick disconnect fitting 174. The pump includes an exhaust line 176 feeding a small capacity tank 178 having a vent 180 to the atmosphere, as depicted by arrow 182. A recirculating line 184 extends from tank 178 to intake line 172. The pump is driven by an electric motor 186, or the like. Intact line 172 may include a sight glass 188 and various valves and check valves to insure safety of operation.

Hollow stanchion 144 may have incorporated therewith a site glass 190 to provide an indication of the degree of vapor and liquid being drawn into tank 140.

The operation of the vapor pocket evacuation system described herein will be with primary reference to FIGS. 1, 7 and 8. Initially, hose 52 is secured to quick disconnect fitting 142 and line 80 (or branch 130) is secured to quick disconnect fitting 146. Pressure vessel 148, containing an inert gas, such as nitrogen under pressure, is connected to fitting 154. If an operator determines that a vapor pocket is most likely to be at the far end of tank 10, as depicted in FIG. 1, a length of hose commensurate with the tank length and depth, along with the length of pipe 22 is determined and marked for future reference. Wand 150 is inserted downwardly with hose 52 trailing thereafter through drop line 20. To establish the propulsion force for wand 50 in order to propel the wand to the far end of the tank, pressure tank 140 includes a quantity of fluid at the bottom thereof which is the same as the fluid within tank 10. Pressure tank 140 will be under pressure as a result of interconnection with pressure vessel 148. Upon opening of a valve associated with fitting 144, fluid from the bottom of pressure tank 140 will be forced through fitting 144 into hose 52 and ejected therefrom through apertures 66 within sleeve 68 (see FIGS. 2 and 3). The resulting flow of fluid from end 74 of the sleeve will create a propulsion force for the wand and cause the wand to begin to travel. Any natural bend in hose 52 (which must be determined beforehand) in combination with the deflection of the propulsion force provided by deflecting surface 78 will result in curved travel of the wand from a downwardly vertical orientation to a lateral orientation in the direction of the far end of tank 10. At or about the time the predetermined length of hose 52 has been inserted within drop line 20, the wand will be in the vicinity of end 24 of tank 10. To insure that the wand is raised to the air pocket, a valve (not shown) is opened to permit a flow of the inert gas from the top of pressure tank 140 through quick disconnect fitting 146 into lines 80 (tubing 122). This flow of gas will inflate bulb 86 to create a buoyant force for the wand. The resulting buoyancy will locate the wand proximate the surface of the fluid defining vapor pocket 32 within tank 10. Furthermore, the location of bulb 86, in combination with the weight of the wand and hose depending therefrom will position inlets 62 within the vapor pocket. The wand is now in position to begin to evacuate the vapor pocket.

As depicted in FIG. 8, pressure vessel 148 may be disconnected from pressure tank 140 and the intake line of pump 170 is connected to the pressure tank. Upon energization of pump 170 through actuation of motor 186, a below ambient pressure will be created within pressure tank 140. The reduced pressure within the pressure tank, which is communicated to inlets 62 via hose 52 will cause the vapor within vapor pocket 32 to be drawn into pressure tank 140 which, in turn, will draw fluid through hose 52 into tank 10 from tank 140. Sight glass 190 associated with fitting 144 will provide an indication of the relative amounts of vapor and liquid being drawn into the pressure tank 140. At some point in time, the vapor pocket will have been essentially evacuated, as indicated by a steady flow of fluid through sight glass 190. At this point, pump 170 may be turned off.

To retrieve wand 50 after evacuation of the vapor pockets of interest within tank 10, the following procedure may be employed. Bulb 86 may be deflated to reduce the buoyancy of wand 50 sufficiently to permit the wand to sink within fluid 28 in tank 10. Simultaneously, hose 52 and line 80 (tubing 122) are withdrawn through drop line 20.

It is to be noted that skilled operators can withdraw hose 52 incrementally prior to deflation of bulb 56 to permit the wand to perform a sweeping action along the topside of tank 10. Furthermore, by suitably marking hose 52 coincident with the location of manways 16 and/or threaded plugs 18, further possible vapor pockets can be detected and evacuated. The use of sight glass 190 in such searching operations may be of great value. Finally, as there usually exists a vapor pocket about the drop line within tank 10, the wand, upon exercise of a certain amount of skill and experience, can be located adjacent the drop line to evacuate any vapor pocket that may exist thereabout.

While certain details with regard to on/off valves and check valves have not been specifically described, it is to be understood that such valves must be employed, as is well known to those skilled in the art, to provide adequate control over the various fluid flows and to prevent flow in a reversed direction that might cause damage or pose a safety hazard.

While the principles of the invention have now been made clear in the illustrated embodiments, there will be immediately obvious to those skilled in the art, many modifications of structures, arrangements, proportions, elements, materials and components used in the practice of the invention and otherwise, which are particularly adapted for specific environments and operational requirements without departing from those principles. The appended claims are therefore intended to cover and embrace any such modifications within the limits only of the true spirit and scope of the invention.

I Claim:

1. A method for evacuating vapor pockets in liquid filled storage tanks, said method comprising the steps of:

a. introducing a wand into the tank, which wand includes a trailing hose;
b. propelling the wand to a vapor pocket, said step of propelling including the step of discharging a fluid from the wand to create a propulsion force;
c. drawing the gaseous content of the vapor pocket through the wand and the trailing hose; and
d. withdrawing the wand and the hose from the tank on completion of said step of drawing.

2. The method as set forth in claim 1 including the step of deflecting the fluid discharged during said step of discharging for urging a specific direction of travel of the wand.

3. A method for evacuating vapor pockets in liquid filled storage tanks, said method comprising the steps of:

a. introducing a wand into the tank, which wand includes a trailing hose;
b. propelling the wand to a vapor pocket;
c. floating the wand to the surface of the vapor pocket;
d. drawing the gaseous content of the vapor pocket through the wand and the trailing hose; and
e. withdrawing the wand and the hose from the tank on completion of said step of drawing.

4. The method as set forth in claim 3 wherein said step of propelling includes the step of discharging a fluid from the wand to create a propulsion force.

5. The method as set forth in claim 3 wherein the wand includes an inflatable element and including the step of selectively inflating the inflatable element to increase the buoyancy of the wand.

6. The method as set forth in claim 1 wherein said step of drawing including the steps of creating a source of below ambient pressure to draw liquid and vapor through the wand and the hose.

7. The method as set forth in claim 7 including the step of segregating the drawn liquid from the drawn gas.

8. The method as set forth in claim 1 wherein said step of withdrawing is exercised subsequent to termination of said propelling and drawing steps.

9. The method as set forth in claim 1 wherein said step of introducing includes the step of orienting the wand and trailing hose relative to the tank in preparation for exercise of said step of propelling.

10. Apparatus for evacuating vapor pockets within a liquid containing tank, said apparatus comprising in combination:

a. a wand;
b. a hose trailing from said wand;
c. means for propelling said wand through the liquid in the tank, said propelling means including means for ejecting a stream of fluid to establish a propulsive force;
d. means for retaining said wand at the surface of the vapor pocket during evacuation of the gas from the vapor pocket; and
e. means for evacuating through said wand and said hose the vapor from the vapor pocket.

11. The apparatus as claimed in claim 10 including means for urging a specific direction of travel of said wand by deflecting the stream of fluid.

12. The apparatus as claimed in claim 11 including means for preventing back flow through said wand of the stream of fluid.

13. The apparatus as claimed in claim 10 wherein said wand includes at least an inlet for receiving a flow of vapor and liquid.

14. The apparatus as claimed in claim 13 wherein said wand includes means for preventing an outflow of fluid through said inlet.

15. Apparatus for evacuating vapor pockets within a liquid containing tank, said apparatus comprising in combination:

a. a wand;
b. a hose trailing from said wand;
c. means for propelling said wand through the liquid in the tank;
d. means for retaining said wand at the surface of the vapor pocket during evacuation of the gas from the vapor pocket, said retaining means including means for floating said wand; and
e. means for evacuating through said wand and said hose the vapor from the vapor pocket.

16. The apparatus as claimed in claim 15 wherein said floating means includes an inflatable member and means for selectively inflating said member.

17. The apparatus as claimed in claim 16 wherein said inflating means includes tubing for conveying a gas to said member, said tubing being disposed within said hose.

18. Apparatus for evacuating vapor pockets within a liquid containing tank, said apparatus comprising in combination:

a. a wand, said wand including a roller for guiding said wand along a surface of the tank;
b. a hose trailing from said wand;
c. means for propelling said wand through the liquid in the tank;
d. means for retaining said wand at the surface of the vapor pocket during evacuation of the gas from the vapor pocket; and
e. means for evacuating through said wand and said hose the vapor from the vapor pocket.

19. The apparatus as claimed in claim 18 wherein said roller is disposed at the tip of said wand and wherein said wand includes at least one inlet for receiving a flow of vapor and liquid.

20. Apparatus for evacuating vapor pockets in underground liquid filled storage tanks, said apparatus comprising in combination:

a. inlet means for receiving vapor from a vapor pocket;
b. means for conveying the vapor from said inlet means to a location external of the tank;
c. means for propelling said inlet means through the liquid in the tank to a vapor pocket; and
d. means for maintaining said inlet means at the liquid surface of the vapor pocket during evacuation of the vapor pocket.

21. The apparatus as claimed in claim 20 wherein said propelling means includes means for discharging a stream of fluid to establish a propulsive force for propelling said inlet means.

22. The apparatus as claimed in claim 21 including means for deflecting the propulsive force to control the direction in which said inlet means is propelled.

23. The apparatus as claimed in claim 22 including means for selectively actuating said discharging means.

24. The apparatus as claimed in claim 23 including means for preventing back flow of the stream of fluid during periods of deactuation of said discharging means.

25. The apparatus as claimed in claim 20 including a source of fluid under pressure for energizing said propelling means and a source of fluid at below ambient pressure for receiving the vapor conveyed by said conveying means.

26. The apparatus as claimed in claim 20 wherein said maintaining means includes a floatation device and means for selectively actuating said floatation device.

27. The apparatus as claimed in claim 26 wherein said floatation device comprises an inflatable bulb and wherein said actuating means comprises a conduit extending between said bulb and a source of gas under pressure.

* * * * *